United States Patent [19]

Olsson

[11] 4,454,391

[45] Jun. 12, 1984

[54] LOW PROFILE DIP SWITCH

[75] Inventor: Billy E. Olsson, New Cumberland, Pa.

[73] Assignee: AMP Incorporated, Harrisburg, Pa.

[21] Appl. No.: 426,355

[22] Filed: Sep. 29, 1982

[51] Int. Cl.[3] ..... H01H 15/00

[52] U.S. Cl. ..... 200/16 D; 200/16 R; 200/291

[58] Field of Search ..... 200/1 R, 6 R, 6 B, 6 C, 200/11 G, 16 R, 16 C, 16 D, 16 F, 252, 291, 302, 303, 5 R

[56] References Cited

U.S. PATENT DOCUMENTS

| | | | |
|---|---|---|---|
| 3,729,600 | 4/1973 | Solomon et al. | 200/16 D |
| 3,963,884 | 6/1976 | Pollock | 200/16 D |
| 4,029,914 | 6/1977 | Schmidt et al. | 200/1 R |
| 4,128,745 | 12/1978 | Marsilio et al. | 200/291 X |
| 4,268,728 | 5/1981 | Rose | 200/16 R |
| 4,326,110 | 4/1982 | Zdanys, Jr. | 200/291 X |
| 4,376,234 | 3/1983 | Liataud et al. | 200/16 D |
| 4,393,281 | 7/1983 | Ohmori et al. | 200/16 D |

OTHER PUBLICATIONS

Gathman, Dave, "Firm Has Big Plans for its Little Switch", In: *Daily Courier News*, (Elgin, IL), Business/-Finance Section, p. 9, May 25, 1983.

*Primary Examiner*—J. R. Scott

*Attorney, Agent, or Firm*—Adrian J. LaRue

[57] ABSTRACT

An electrical switch of the dual-in-line package type comprises a dielectric housing having a recess in a top surface thereof. Stationary electrical contact members are sealingly secured in the housing at spaced intervals along opposed sides of the housing as opposed pairs of contact members. Inner contact sections of the contact members are located within the recess and outer contact sections of the contact members extend outwardly from the housing. Bow-shaped movable contact members are secured to dielectric operating members for electrically connecting respective pairs of contact members in a first position and for disconnecting the pairs of contact members in a second position. A cover member is sealingly secured onto the top surface of the housing and openings extend through the cover member. An operating section of the operating members extends through a respective one of the openings and the operating members include flexible cover sections covering the movable contact members. Detent members on the inside surface of the cover member and on the cover sections of the operating members to maintain the operating members in the first or second position.

14 Claims, 10 Drawing Figures

Fig. 2
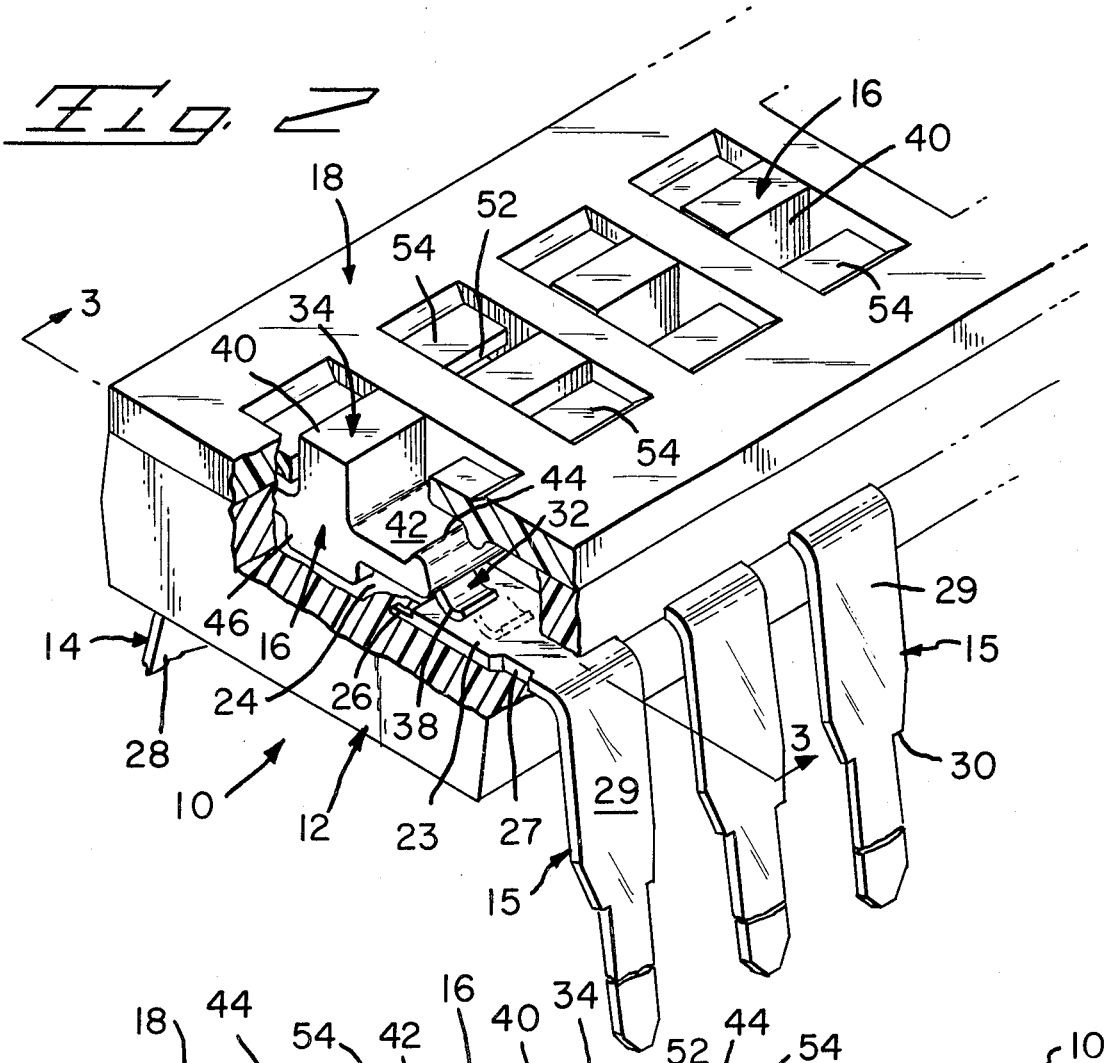
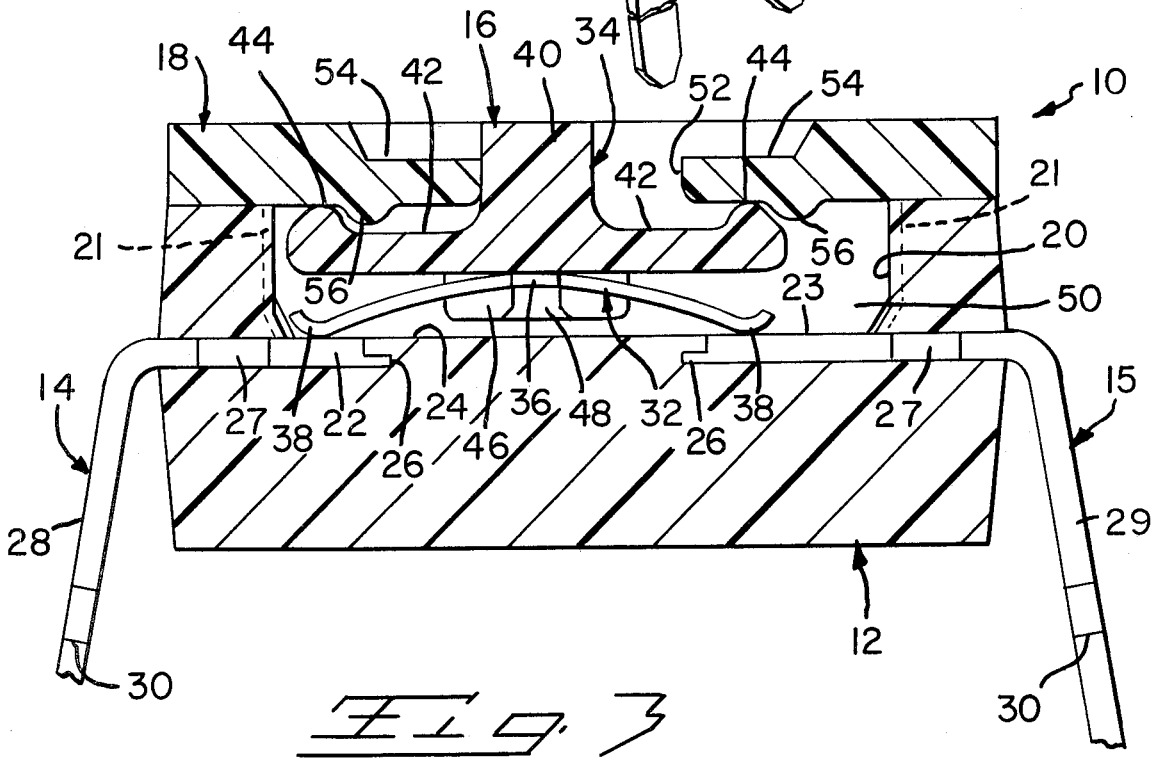
Fig. 3

LOW PROFILE DIP SWITCH

FIELD OF THE INVENTION

This invention relates to switches and more particularly to dual-in-line package switches having a low profile.

BACKGROUND OF THE INVENTION

The use of DIP switches and other components, especially integrated circuits on printed circuit boards, is increasing. This results in more area of the board being used while board size in many cases remains constant. Heretofore DIP switches were larger in size including height than integrated circuits. It is therefore important that the size of the DIP switches be taken into consideration when used on printed circuit boards. Hence, the size of the DIP switches must be made smaller to correspond to the size of integrated circuit packages including their height, i.e., their profile. Thus, the actuating members of the DIP switches cannot extend above the top surfaces of the switches.

These smaller size DIP switches would be usable in automatic insertion equipment that is presently used for IC packages. The contacts extending from the housing should be of no-leak construction and no metal in the areas containing the actuating members should be exposed.

SUMMARY OF THE INVENTION

According to the present invention, an electrical switch of the dual-in-line package (DIP) type comprises a dielectric housing having a recess in a top surface thereof. Stationary electrical contact members are sealingly secured in the housing at spaced intervals along opposed sides of the housing as opposed pairs of contact members. Inner contact sections of the contact members are located within the recess and outer contact sections of the contact members extend outwardly from the housing. Bow-shaped movable contact members are secured to dielectric operating members for electrically connecting respective pairs of contact members in a first position and for disconnecting the pairs of contact members in a second position. A cover member is sealingly secured onto the top surface of the housing and openings extend through the cover member. An operating section of the operating members extends through a respective one of the openings and the operating members include flexible cover sections so that the operating members completely cover the movable contact members. Detent members on the inside surface of the cover member and on the cover sections of the operating members to maintain the operating members in the first or second position.

BRIEF DESCRIPTION OF THE DRAWINGS

FIG. 2 is a view similar to FIG. 1 showing the switch in an assembled condition with parts of the housing and cover member broken away.

FIGS. 3 through 5 are cross-sectional views of FIG. 2 taken along lines 3—3 thereof showing the operational positions of the switch.

DETAILED DESCRIPTION OF THE EMBODIMENTS OF THE INVENTION

Figure 1:
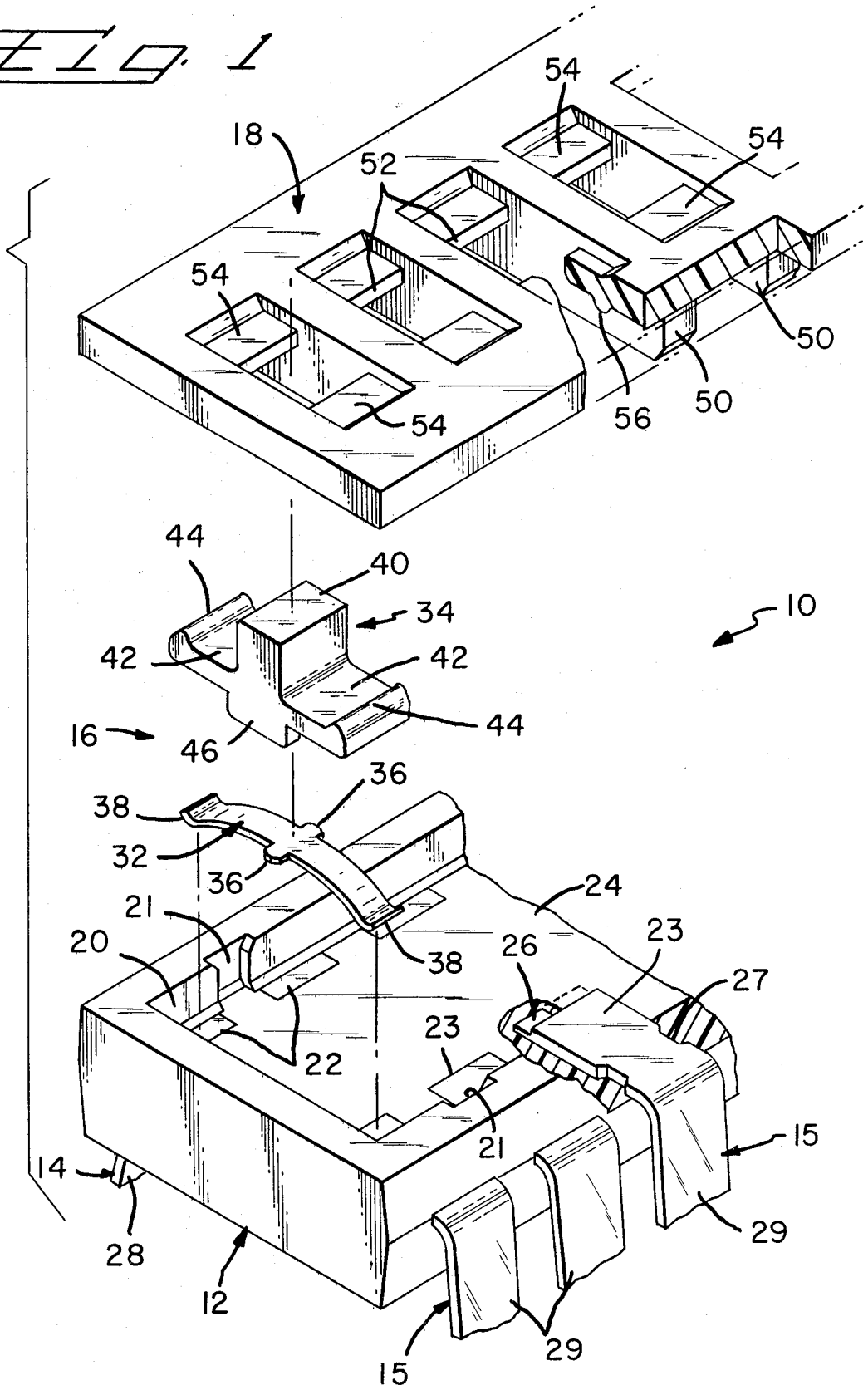
FIG. 1 is a perspective and exploded view showing parts of the switch of the present invention with parts of the housing and cover member broken away.

FIGS. 1 and 2 illustrate electrical switch 10 which is of the dual-in-line (DIP) type and it includes a dielectric housing 12, stationary electrical contact members 15, movable electrical contact assemblies 16, and a cover member 18.

Housing 12 is molded from a suitable dielectric material and has stationary electrical contact members 14 molded in position therein along opposing sides of housing 12 at spaced intervals therealong. A recess 20 is located in the top surface of housing 12 and stationary electrical contact members 14, 15 each have inner contact sections 22, 23 respectively. The contact surfaces of contact sections 22, 23 are in the same plane as bottom surface 24 of recess 20. Each inner contact section 22, 23 has a stepped section 26 to maintain the contact sections in position in housing 12 so that the upper surfaces of inner contact sections 22, 23 remain coplanar with bottom surface 24 to provide a smooth surface therebetween. Necked-down areas 27 are located in electrical contact members 14, 15 to maintain them in position in housing 12 against lateral forces. Electrical contact members 14, 15 have outer contact sections 28, 29 respectively which extend outwardly from housing 12 in an angular orientation relative thereto for electrical engagement with socket members in a printed circuit board or soldered to conductive paths on a printed circuit board. Stop surfaces 30 are located on outer contact sections 28, 29 to engage the sockets or the printed circuit board to position the switch 10 slightly above the surface of the printed circuit board to allow for washing away flux and to enable air to flow between the switch and the board. As can be discerned, stationary contact members 14, 15 are positioned along opposed sides of housing 12 at spaced intervals therealong as opposed pairs of contact members.

Figure 4:
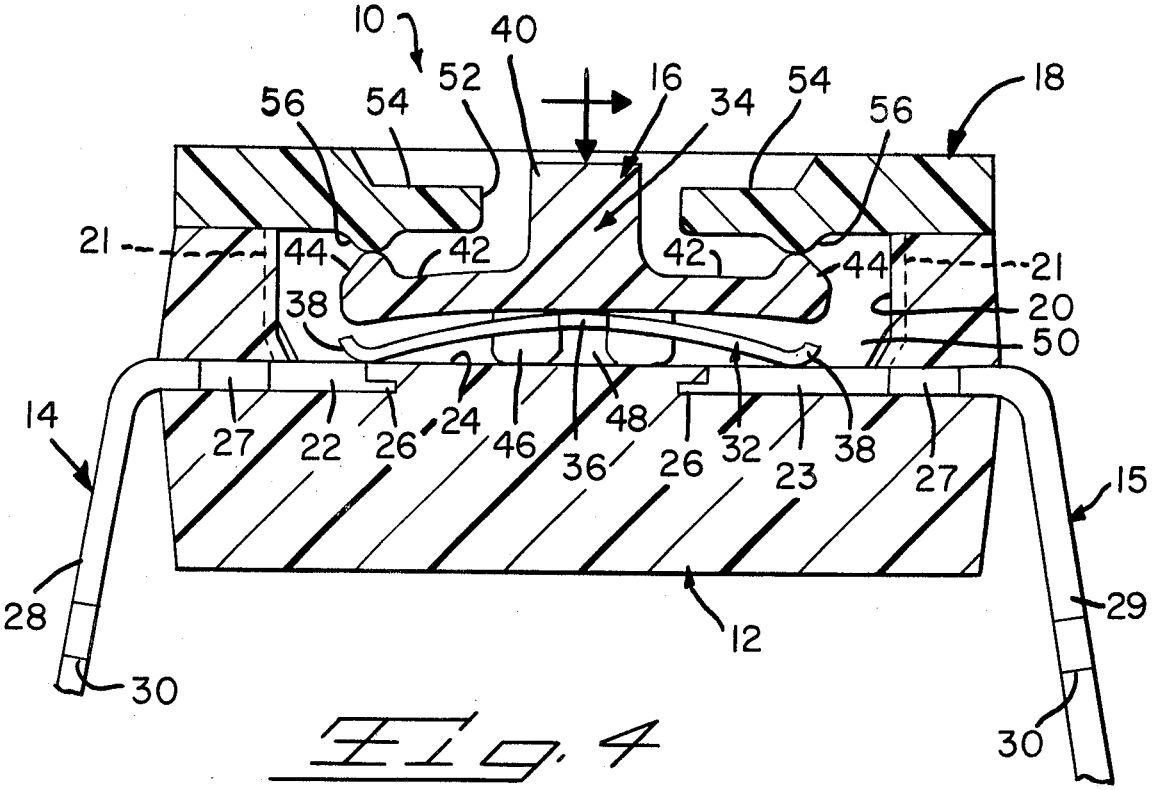

Each of movable electrical contact assemblies 16 comprises a bow-shaped electrical contact member 32 and dielectric operating member 34. Electrical contact member 32 has lugs 36 at its midpoint and the ends 38 of contact member 32 are radiussed for sliding electrical engagement with respective inner contact sections 22, 23 as shown in FIG. 3. Operating member 34 is molded from a suitable plastic material and it includes a rectangular-shaped section 40 from opposing sides of which extend flexible cover sections 42 which have radiussed detents 44 at their outer ends. Opposed projections 46 extend outwardly from the bottom surface of operating member 34 along each side thereof and they have recesses 48 therein with beveled entrances thereto in which lugs 36 of electrical contact member 32 are friction fitted thereby securing electrical contact member 32 in position within operating member 34 with the central section of contact member 32 containing lugs 36 engaging the bottom surface of operating member 34 as shown in FIGS. 3 through 5.

Cover member 18 is molded from a suitable plastic material, walls 50 extending downwardly from the inner surface at spaced intervals therealong with the exception of the ends. Rectangular openings 52 extend through cover member 18 between walls 50 and the ends of cover member 18 and the wall adjacent thereto. Rectangular-shaped sections 40 of operating members 34 extend into openings 52 and are movable therealong between respective walls 50 or between a respective wall 50 and an end wall of recess 20 of housing 12 as shown in FIG. 2. This arrangement provides separate compartments for discrete switch operating sections. The outer ends of sections 40 do not extend above the outer surface of cover member 18. Opposing sides of openings 52 limit movement of sections 40 therein thereby limiting movement of the operating members in their respective compartments. The top surface of cover member 18 on each side of opening 52 has recesses 54 with the outer ends beveled to enable the pointed end of a member to be moved into engagement with operating member 34 to move operating member 34 from one end of opening 52 to the other. Projections 56 extend outwardly from the inner surface of cover member 18 between walls 50 and outwardly from each end wall. The spring characteristics of bow-shaped electrical contact member 32 urge detents 44 in engagement with the inside surface of cover member 18 alongside respective projections 56 thereby maintaining movable electrical contact assemblies 16 in an operated position with radiussed ends 38 of electrical contact member 32 in electrical engagement with respective inner contact sections 22, 23 as shown in FIG. 3 or in a non-operative position as shown in FIG. 5 with radiussed end 38 of contact member 32 in engagement with inner contact section 23 with the other radiussed end 38 out of engagement with inner contact section 22 but onto surface 24. Radiussed ends 38 smoothly slide along contact sections 22, 23 and the one radiussed end 38 that slides along contact section 22 also slides smoothly along surface 24.

To assemble electrical switch 10, stationary electrical contact members 14, 15 are typically stamped and formed in accordance with conventional stamping and forming operations as part of a lead frame with contact members 14, 15 extending outwardly from carrier strips and in the same plane thereof. Contact sections 22, 23 are gold-plated. Contact members 14, 15 are placed in a mold so that housing 12 is molded onto contact members 14, 15 with the upper surfaces of inner contact sections 22, 23 being coplanar with bottom surface 24 of recess 20 and outer contact sections 28, 29 extending outwardly from housing 12. Bow-shaped electrical contact members 32 are stamped and formed from a suitable metal strip having the required spring characteristics and having radiussed ends 38 gold-plated, and lugs 36 are friction fitted in recesses 48 of projections 46 of dielectric operating members 34 to form movable electrical contact assemblies 16 which are then positioned in cover member 18 in its upside-down position so that rectangular-shaped sections 40 are positioned in openings 52. After movable electrical contact assemblies 16 have been positioned in cover member 18, housing 12 with contact members 14, 15 molded in position therein is adhesively secured to cover member 18. Opposing walls of recess 20 have recesses 21 therein which are frictionably engaged by the ends of respective walls 50 that are slightly longer than the other walls 50 thereby holding cover member 18 onto housing 12 while the adhesive sets up. Thereafter, contact member 14, 15 are separated from the lead frame and from one another and outer contact sections 28, 29 are bent into their angular orientation relative to housing 12 thereby forming a completed DIP switch 10.

Figure 5:
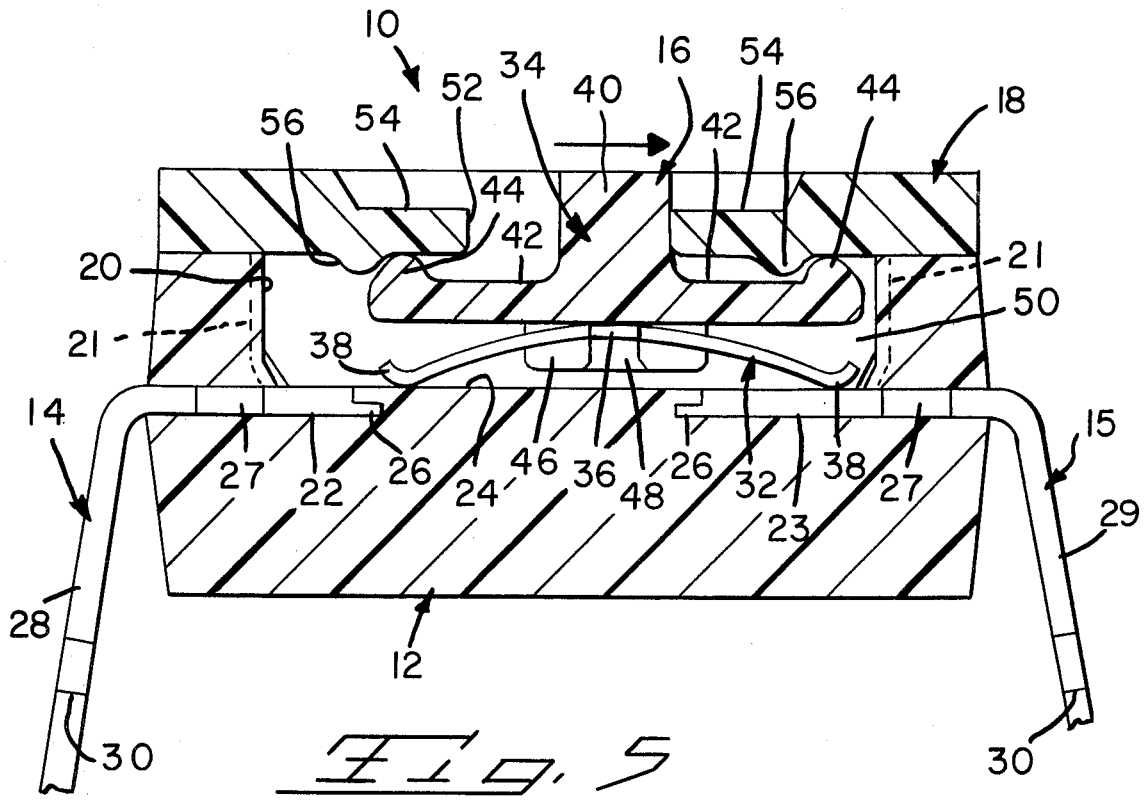
Figure 6:
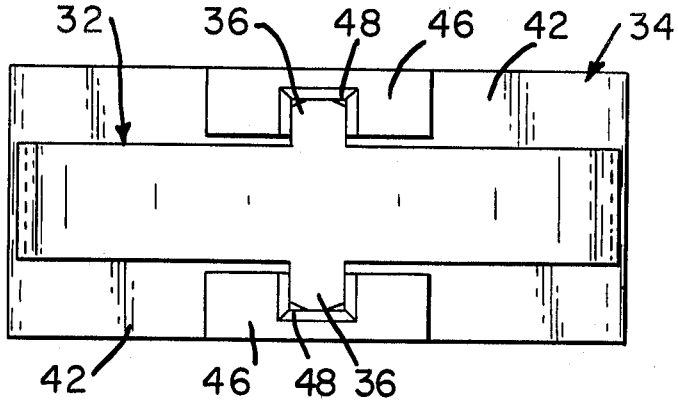
FIG. 6 is a bottom plan view of the operating member.

When movable electrical contact assemblies 16 are moved from an operated position as shown in FIG. 3 to a non-operated position as shown in FIG. 5 or vice-versa, a linear force is applied to section 40 of operating member 34 causing detents 44 to move along projections 56 which moves the bottom surfaces of projections 46 into slidable engagement with bottom surface 24 of recess 20. This prevents over-stressing of spring contact member 32. When the high points of detents 44 and projections 56 are coincident, cover sections 42 deflect downwardly thereby absorbing the major downward forces so that the spring contact member 32 does not absorb more than a fraction of the downward forces. The movement of detents 44 along projections 56 provide tactile operation signifying the on and off positions. With the bottom surfaces of projections 46 engaging surface 24 of recess 20 thereby limiting the downward force onto spring contact member 32, this prevents scoring of the contact sections 22, 23 when radiussed ends 38 slide thereacross. Cover sections 42 completely cover spring contact member 32 which does not expose any of the stationary and movable contact assemblies from above. The presence of recesses 48 and projections 46 of operating member 34 accurately locates and securely maintains the spring contact members 32 therein. The flexible nature of cover sections 42 coupled with the spring action of spring contact member 32 in forcing detents 44 into engagement with the inner surface of cover member 18 and along projections 56 when the movable electrical contact assembly 16 is moved from one position to another acts as a seal to prevent foreign objects from entering the contact assembly. The sides of operating members 34 along walls 50 and along the end walls of recess 20 act as guides to stabilize movement of the operating members.

Figure 7:
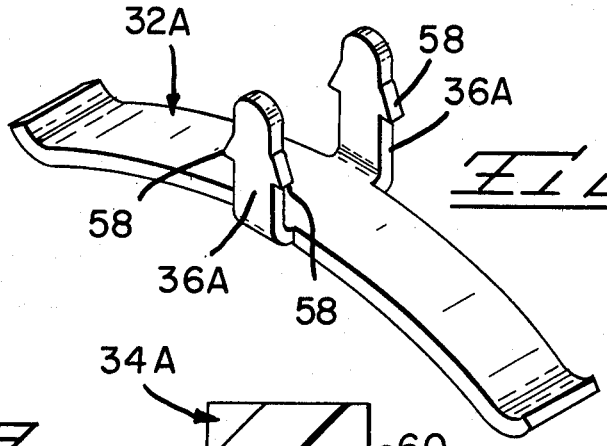
FIGS. 7 and 8 are perspective views of alternative embodiments of movable spring contact members.
Figure 9:
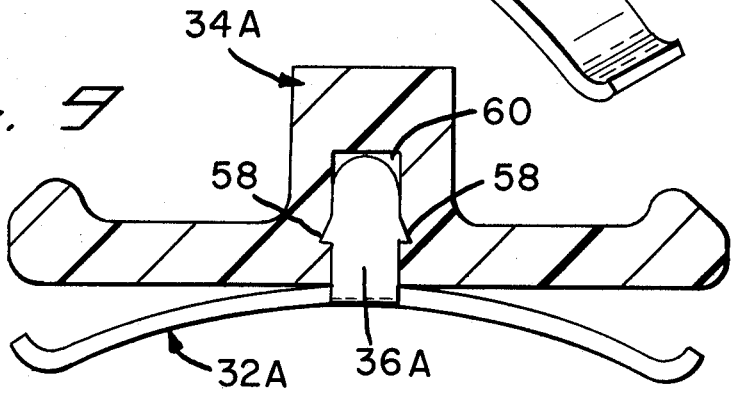
FIGS. 9 and 10 are cross-sectional views showing the spring contact members secured in the operating members.
Figure 8:
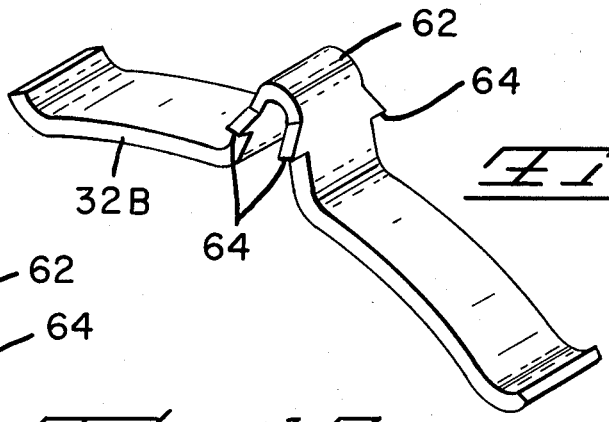

The electrical switch of the present invention has a low profile and is of the same size as integrated circuit packages. Operating member 34 does not extend above the upper surface of cover member 18. FIGS. 7 and 8 show alternative spring contact members 32A, 32B. Spring contact member 32A has the same configuration as spring contact member 32 except that projections 36A are at right angles with respect to main section of contact member 32A and include barbs 58 which secure projections 36A in recesses 60 as shown in FIG. 9.

Figure 10:
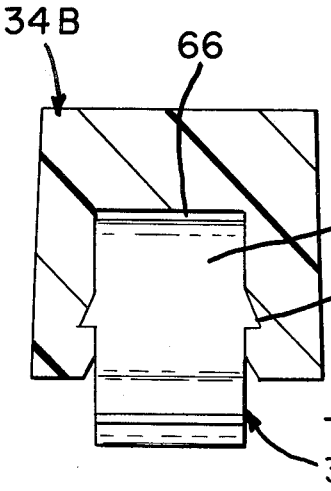

Spring contact member 32B has a U-shaped section 62 at the central section thereof which contains barbs 64 that bite into operating member 34B when U-shaped section 62 is forced into recess 66 of operating member 34B as shown in FIG. 10.

As can be discerned, a low profile DIP switch has been disclosed which includes an operating member completely covering the spring movable contact member with flexible cover sections of the operating member having detents that cooperate with projections on an inside surface of a cover member to maintain the movable contact member in an operative or non-operative position with tactile feel.

I claim:

1. An electrical switch of the type comprising stationary electrical contact members secured in a dielectric housing member, opposed inner contact sections of the contact members are coplanar with an upper surface of the housing member and are spaced from each other, outer contact sections of the contact members extend outwardly from respective sides of the housing member, a movable electrical contact assembly including a movable electrical contact member secured to a dielectric operating member, said movable electrical contact assembly adapted to be moved from one position with the movable electrical contact member having ends in electrical engagement with the inner contact sections to another position with one of the ends of the movable electrical contact member only engaging one of the inner contact sections and said upper surface of said housing member, and a cover member with an opening therethrough secured to said housing member, a section of the operating member extending through the opening, characterized in that:

said operating member has flexible cover sections extending along but spaced from said movable electrical contact member and also extending along an inner surface of said cover member, outer ends of said cover sections engaging said inner surface of said cover member;

projections extending outwardly from a bottom surface of said operating member, said movable electrical contact member having section members engaging said operating member thereby securing the movable electrical contact member to said operating member and the spring force of the movable electrical contact member forces the outer ends of the cover sections in engagement with said inner surface of said cover member;

said operating member completely covering said movable electrical contact member and said outer ends of said cover sections in engagement with said inner surface keeping foreign matter from getting into the contact area.

2. An electrical switch as set forth in claim 1 characterized in that said inner surface of said cover member on each side of said opening has projection sections and said outer ends of said cover sections are in the form of detents, the projection sections and detents cooperate to maintain the movable electrical contact assembly in the one or the other position and the movement of the detents along the projection sections provides a tactile snapping action.

3. An electrical switch as set forth in claim 2 characterized in that said projections engage and slide along said upper housing surface when said detents move along said projection sections so as not to overstress said movable electrical contact member and said cover members flex as said detents move along said projection sections.

4. An electrical switch as set forth in claim 1 characterized in that said projections have recesses and said section members of said movable electrical contact member are secured in said recesses.

5. An electrical switch as set forth in claim 1 characterized in that said section members of said movable electrical contact member extend normal with respect to the body of said movable electrical contact member, said section members extending into recesses of said operating member and having barbs biting into the walls thereof.

6. An electrical switch as set forth in claim 1 characterized in that said section members of said movable electrical contact member are in the form of a U-shaped section disposed in a recess in said operating member and having barbs biting into the walls of the recess.

7. An electrical switch, comprising:

dielectric body means having an upper planar surface;

electrical contact means sealingly secured in opposing sides of said housing means as pairs of contact means, said contact means including inner contact means coplanar with said upper planar surface and outer contact means extending outwardly from said housing means;

movable electrical contact means including spring contact means and dielectric operating means, securing means on said spring contact means and said operating means securing said spring contact means to said operating means, said spring contact means having ends for slidable movement along said inner contact means to one position of electrical engagement therebetween and for slidable movement along said upper planar surface and one of said inner contact means to another position, said operating means including section means and flexible cover section means, said cover section means extending along but spaced from said spring contact means and including end means;

cover means having opening means extending therethrough, said cover means secured to said housing means with said section means of said operating means disposed in said opening means for engagement by an operator to move said movable electrical contact means from the one position to the other position, said spring contact means springably urging said end means of said flexible cover section means against an inner surface of said cover means and said operating means completely covering said spring contact means.

8. An electrical switch as set forth in claim 7 wherein said cover means has wall means extending outwardly from said inner surface at spaced intervals therealong and extending to said upper planar surface to separate said pairs of contact means and along which sides of said operating means move.

9. An electrical switch as set forth in claim 7 wherein said operating means has projection means extending outwardly from the bottom surface of said cover section means, said securing means includes recess means in said projection means engaged by lug means on said spring contact means.

10. An electrical switch as set forth in claim 7 wherein said operating means has projection means extending outwardly from the bottom surface of said cover section means, said securing means includes recess means of said cover section means and said section means with barbed lug means of said spring contact means disposed in said recess means in engagement with the walls of said recess means.

11. An electrical switch as set forth in claim 7 wherein said securing means includes recess means in said cover section means and said section means with a U-shaped section of said spring contact means disposed in said recess means, said U-shaped section having barbs secured in the walls of said recess means.

12. An electrical switch as set forth in claim 7 wherein projection member means extend outwardly from the inner surface of said cover means on opposing sides of said opening means, said end means of said cover section means defining radiussed detent means, said detent means cooperating with said projection member means to maintain said movable electrical contact means in the one or the other position and to provide a tactile snapping action.

13. An electrical switch as set forth in claim 7 wherein the ends of said spring contact means are radiussed.

14. An electrical switch as set forth in claim 7 wherein recess sections are located in an upper surface of said cover means on opposing sides of said opening means.

* * * * *